US006499981B1

(12) United States Patent
Yoshida

(10) Patent No.: US 6,499,981 B1
(45) Date of Patent: Dec. 31, 2002

(54) DRAWING UNIT

(75) Inventor: Katsuhiko Yoshida, Osaka (JP)

(73) Assignee: Kabushiki Kaisha Kobe Seiko Sho, Osaka (JP)

( * ) Notice: Subject to any disclaimer, the term of this patent is extended or adjusted under 35 U.S.C. 154(b) by 149 days.

(21) Appl. No.: 09/618,136

(22) Filed: Jul. 17, 2000

(30) Foreign Application Priority Data

Jul. 26, 1999 (JP) ..... 11-210178

(51) Int. Cl.[7] ..... D01D 5/14; D04H 3/02

(52) U.S. Cl. ..... 425/66; 425/72.2; 425/81.1; 425/83.1; 425/377

(58) Field of Search ..... 425/66, 72.2, 81.1, 425/83.1, 377

(56) References Cited

U.S. PATENT DOCUMENTS

| | | | | |
|---|---|---|---|---|
| 3,502,763 A | * | 3/1970 | Hartmann | 425/72.2 |
| 3,509,009 A | | 4/1970 | Hartmann | |
| 3,802,817 A | | 4/1974 | Matsuki et al. | |
| 4,340,563 A | | 7/1982 | Appel et al. | |
| 4,812,112 A | * | 3/1989 | Balk | 425/66 |
| 5,302,220 A | | 4/1994 | Terakawa et al. | |
| 5,863,565 A | * | 1/1999 | Rossillon et al. | 425/72.2 |
| 5,935,512 A | * | 8/1999 | Haynes et al. | 425/66 |

FOREIGN PATENT DOCUMENTS

| | | |
|---|---|---|
| DE | 1950435 | 4/1971 |
| JP | 42027599 | 12/1967 |
| JP | 43026576 | 11/1968 |
| JP | 43026584 | 11/1968 |
| JP | 43026599 | 11/1968 |
| WO | WO 93/24693 | 12/1993 |

* cited by examiner

*Primary Examiner*—Jan H. Silbaugh
*Assistant Examiner*—Joseph Leyson

(57) ABSTRACT

A drawing unit including two or more slits extending in a widthwise direction of a collecting conveyor, each slit including an inlet for sucking groups of filaments pushed out from a spinneret, a path in which air currents flowing in a suction direction is formed for drawing the groups of filaments, and an outlet for blowing out the groups of filaments towards the collecting conveyor after the drawing. The drawing unit and a drawing method are capable of producing a non-woven fabric web with uniform thickness and with only a small number of density spots as a result of reduced entanglement of the filaments in the paths of the drawing unit.

18 Claims, 8 Drawing Sheets

DRAWING UNIT

BACKGROUND OF THE INVENTION

1. Field of the Invention

The present invention relates to a drawing unit and method used in forming a non-woven fabric web structure formed of, for example, synthetic polymer fiber.

2. Description of the Related Art

As disclosed in, for example, Japanese Examined Patent Application Publication No. 49-30861 and Japanese Examined Utility Model Publication No. 63-15346, a conventional drawing unit used in forming a non-woven fabric web structure formed of, for example, synthetic polymer fiber is constructed so that a group of filaments from a spinneret is sucked into one long, thin path where air currents are produced in order to draw the filaments and subject them to an opening process.

However, the air currents produced in the one path of the conventional drawing unit are colliding currents, so that turbulence occurs in the air currents in the path, thereby disturbing the flow of the filaments in the path. This leads to the problem that the state of accumulation of the filaments during a post-processing operation gets adversely affected as a result of, for example, entanglement of the filaments. In other words, this leads to the problem that density spots, for example, are produced in the obtained non-woven fiber web structure as a result of entanglement of the filaments in the path, so that the non-woven fabric web structure cannot be produced with uniform thickness.

In addition, in the conventional drawing unit, when, in order to increase productivity of non-woven fabric web structures, the number of groups of filaments pushed out from the spinneret is increased, the number of groups of filaments sucked into the long, thin path formed in the conventional drawing unit is also increased, thus aggravating the above-described problem that a non-woven fabric web structure with uniform thickness cannot be obtained.

Further, there is another problem. Angles within which groups of filaments are contained at a suction inlet of the conventional drawing unit are such as to cause more frequent occurrences of differences in the fineness of the filament groups from a spinning hole of the outermost row of the spinneret and the fineness of the filament groups from a spinning hole of the center row of the spinneret are made after drawing.

SUMMARY OF THE INVENTION

Accordingly, it is an object of the present invention to provide a drawing unit and method capable of producing a non-woven fabric web structure having few density spots and having uniform thickness as a result of reduced entanglement of filaments in a path formed in the drawing unit.

In order to overcome this problem, there is provided a drawing unit for producing a non-woven fabric web, comprising:

- a plurality of slits for drawing filaments, in which groups of filaments pushed out from a spinneret divide and are sucked into the plurality of slits in order to be drawn by air currents formed in the slits; and
- a collecting conveyor for collecting the filaments blown out from the slits in order to form the non-woven fabric web;
- wherein the plurality of slits extend in a widthwise direction of the collecting conveyor, and are disposed substantially parallel to a direction of movement of the collecting conveyor.

By virtue of this structure, it is possible to reduce the number of filaments per slit, and to reduce entanglement of the filaments in each slit, so that a non-woven fabric web with uniform thickness can be obtained. The number of filaments can be increased by increasing the number of slits, so that productivity of non-woven fabric webs can be increased.

The slits may be formed between a first member including an air ejection section and a plate, and between a second member including an air ejection section and the plate, the plate being disposed between the first member and the second member. By virtue of this structure, a width can be adjusted by the thickness of the plate disposed between the first member and the second member. By adjusting the width, the groups of filaments blown out from the slits can join above the collecting conveyor. In other words, the groups of filaments blown out from two slits disposed side by side are brought together inwardly toward each other due to stagnation of air between the two slits in order to join together above the collecting conveyor. This allows a non-woven fabric web with uniform thickness to be obtained.

An air current adjustor plate may be mounted below the plate. By virtue of this structure, the degree with which the groups of filaments blown out from the two slits disposed side by side are joined can be adjusted, making it possible to obtain a non-woven fabric web with uniform thickness.

DESCRIPTION OF THE PREFERRED EMBODIMENTS

Preferred embodiments of the present invention are described below with reference to FIGS. 1 to 5.

Figure 1:
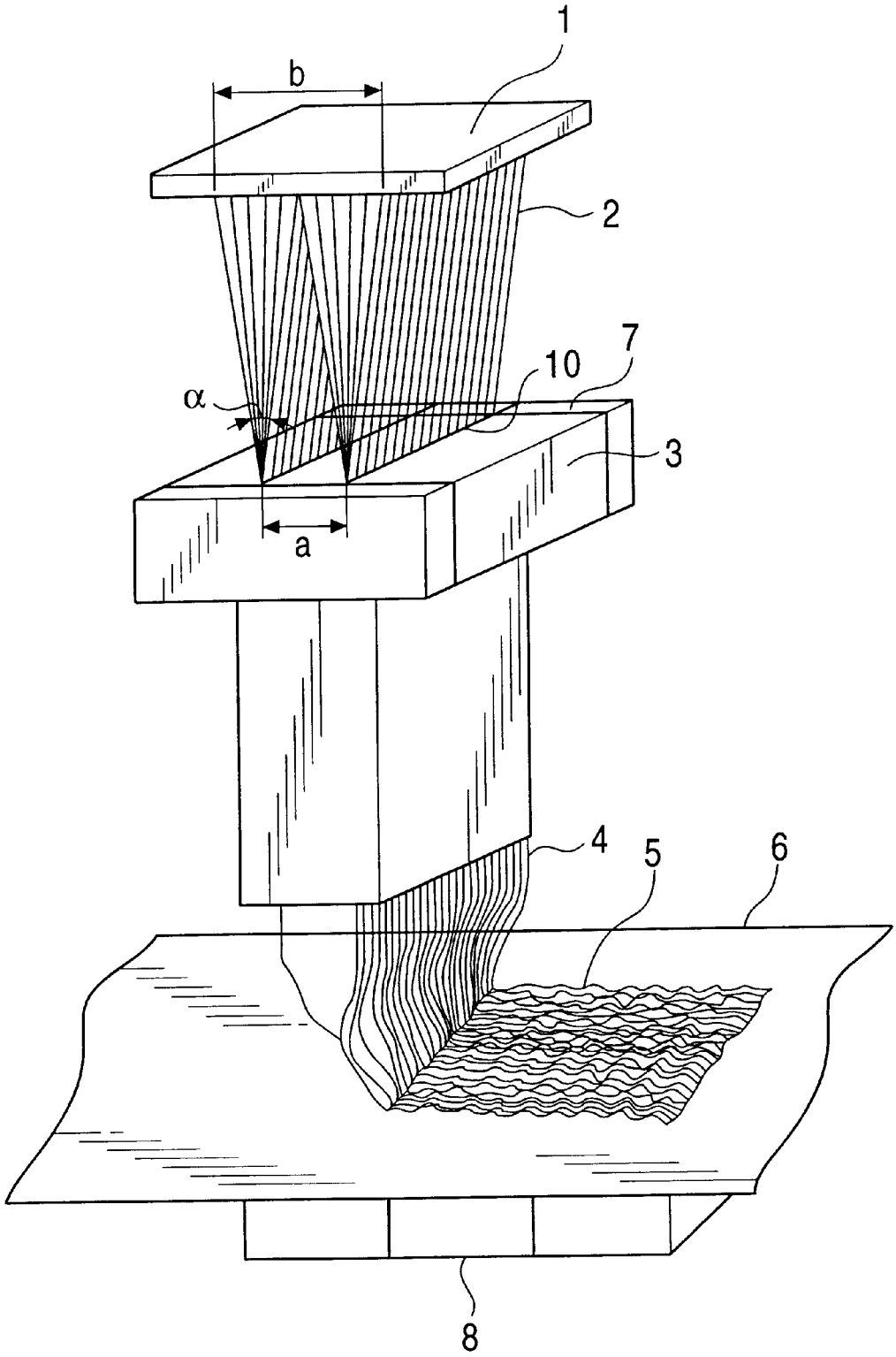
FIG. 1 is a perspective view schematically illustrating an embodiment of the present invention.

FIG. 1 is a perspective view of an apparatus used to produce a non-woven fabric web structure using a drawing unit in accordance with the present invention. In FIG. 1, a drawing unit 3 is disposed below a spinneret 1 with a plurality of holes. A collecting conveyor 6 including a suction box 8 is disposed below the drawing unit 3. Filaments 2 pushed out from the spinneret 1 divide at two slits 10 formed in the drawing unit 3, are sucked into the slits 10, and are drawn in the slits 10 in order to be subjected to an opening process, whereby continuous fibers 4 are formed. The slits 10 extend in a widthwise direction of the collecting conveyor 6. Air currents blown out from the slits 10 cause the continuous fibers 4 subjected to the opening process to join together above the collecting conveyor 6, whereby a non-woven fabric web structure 5 is formed on the collecting conveyor 6.

Figure 2:
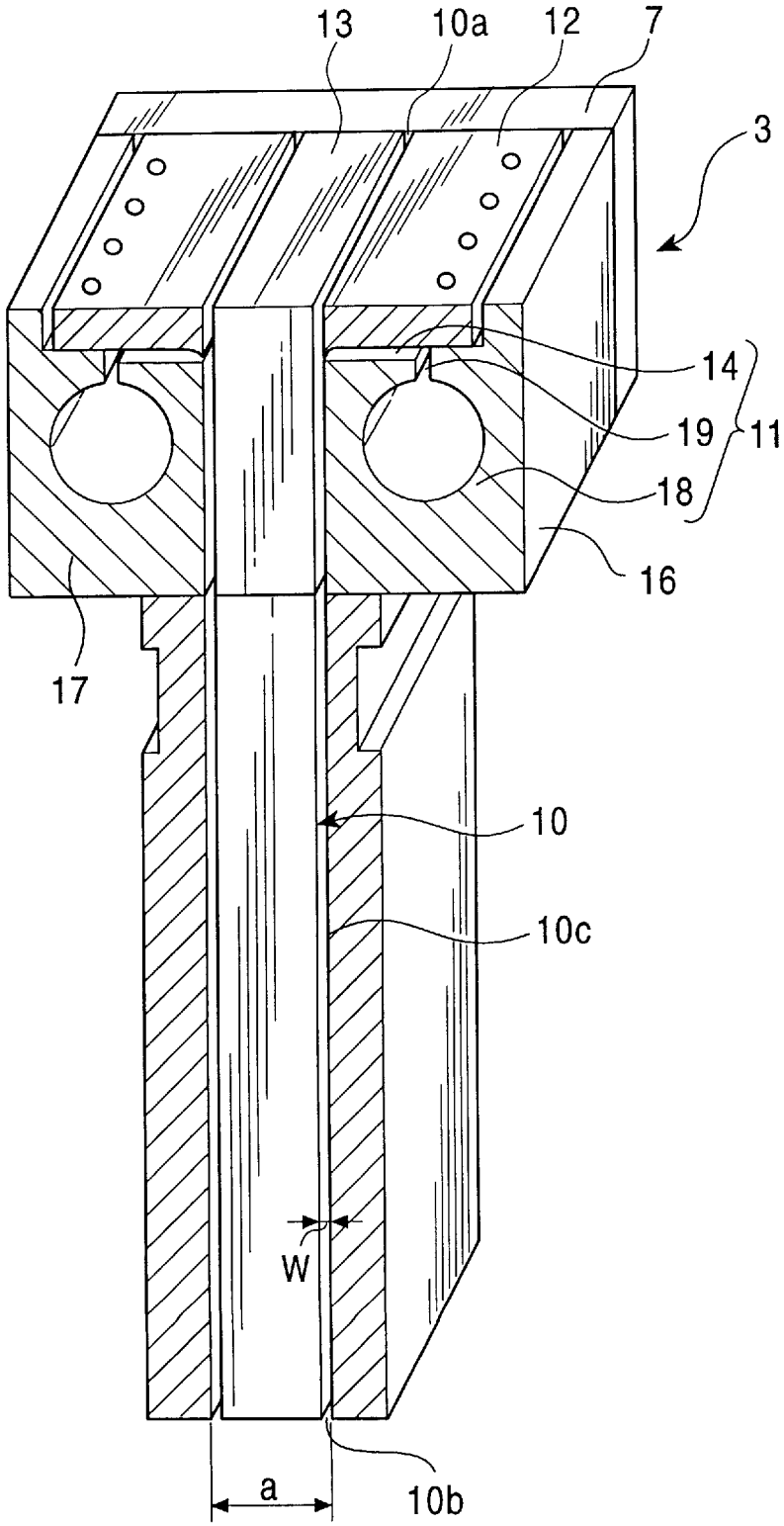
FIG. 2 is a perspective view illustrating an embodiment of the drawing unit in accordance with the present invention.
Figure 3:
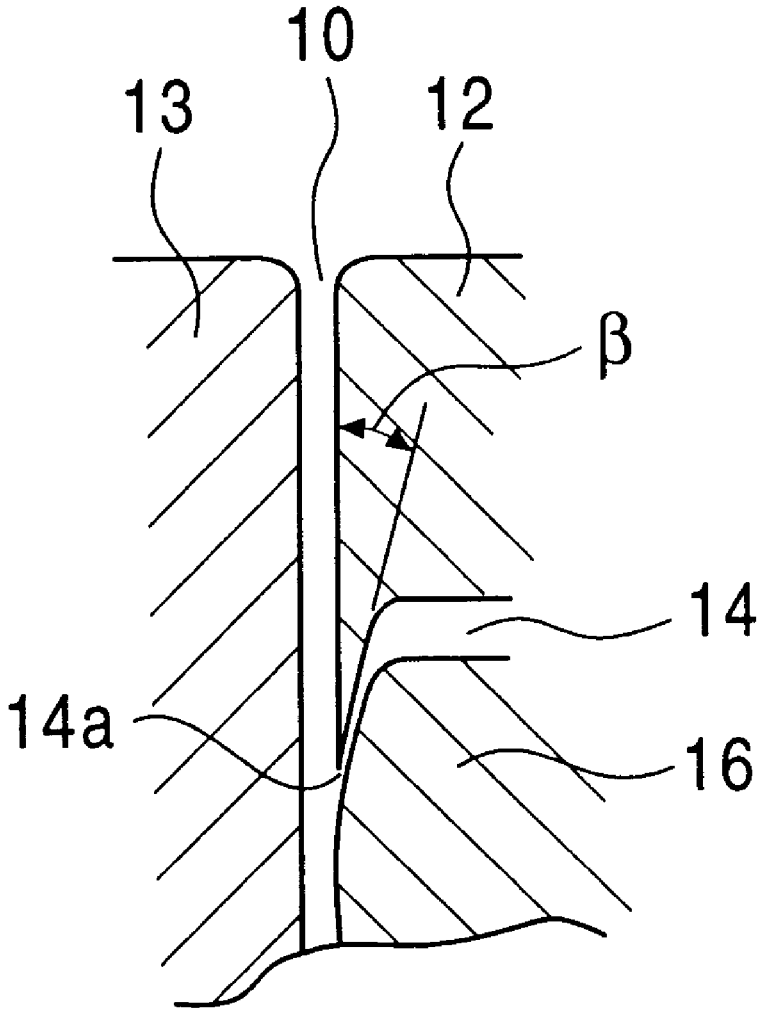
FIG. 3 is an enlarged view illustrating an air ejection opening of the drawing unit in accordance with the present invention.

A description of the structure of the drawing unit 3 is given with reference to FIGS. 2 and 3.

In FIG. 2, the drawing unit 3 comprises a first member 16 including an air ejection section 11, a second member 17, a plate 13 disposed between the members 16 and 17, top plates 12, and a side plate 7. The slits 10 are formed in two rows between the first member 16 and the plate 13 and between the second member 17 and the plate 13, respectively. The first member 16, the second member 17, and the plate 13 are mechanically secured to the side plate 7 with, for example, screws.

The slits 10 formed between the first member 16 and the plate 13 and between the second member 17 and the plate 13 each include a suction inlet 10*a* for sucking therein a group of filaments pushed out from the spinneret 1, a path 10*c* in which air currents flowing in a suction direction are formed to draw the group of filaments, and an outlet 10*b* for blowing out the group of filaments towards the collecting conveyor 6 after the filaments have been drawn.

It is preferable that a gap "a" between the two rows of slits 10 be in a range from 50 mm to 120 mm. If the gap "a" is in this range, the groups of the filaments well join together above the collecting conveyor.

A width w of each exit of each slit 10 can be adjusted by changing the-location where the first member 16 is secured to the side plate 7 or the location where the second member 17 is secured to the side plate 7. The width w of each exit of each slit 10 is preferably in a range of from 3 mm to 8 mm. When the width w of each exit is small, entanglement of the filaments or other such problems may occur. When the width w of each exit is large, it becomes difficult to make the air currents in each slit 10 flow at a predetermined speed, thereby preventing the groups of filaments from being sufficiently drawn. It is preferable that each slit 10 become wider towards the lower portion thereof. This causes the air currents in each slit 10 to flow at a lower speed as they come closer the lower portion thereof, so that the speed of flow of the air currents blown out from each outlet 10*b* can be reduced, making it possible to reduce the amount of air sucked by the suction box 8 disposed below the collecting conveyor 6.

Each air ejection section 11 which functions to form air currents in each slit 10 comprises a main air chamber 18 which is cylindrical and connected to an air supply source (not shown), an air connecting path 19 formed so as to extend upward from its corresponding main air chamber 18, and a second chamber 14 (such as an air ejection tunnel shown in FIG. 3) defined by the first member 16 or the second member 17 and its corresponding top plate 12.

FIG. 3 is an enlarged view of an air ejection opening 14*a* connected to a slit 10 from a second air chamber 14. There is an air ejection hole 14*a* between the second chamber 14 and the respective slit 10. In FIG. 3, an edge is formed at an end surface of a top plate 12 adjacent to the slit 10 so as to extend in a direction in which the filaments flow. By adjusting the extent to which the top plates 12 are secured to the first member 16 and the second member 17, respectively, with, for example, screws, gaps defined by the edges can be adjusted. By adjusting the sizes of the gaps defined by the edges, that is, the sizes of the air ejection holes 14*a*, the speed of flow of the air currents in the slits 10 can be adjusted.

Returning to FIG. 2, the air ejection sections 11 are formed in the first member 16 and the second member 17. They are disposed so as to oppose both sides of the plate 13 at the center portion of the drawing unit 3.

The plate 13 is disposed between the first member 16 and the second member 17. The gap "a" (see FIG. 1) between the slits 10 can be adjusted by adjusting the thickness of the plate 13. It is preferable that the gap "a" between the slits 10 be narrower than a width b of the filaments pushed out from the spinneret 1. This makes it possible to reduce angles $\alpha$ within which the corresponding filament groups 2 are contained when they enter their corresponding slits 10 after the filaments groups 2 pushed out from the spinneret 1 have divided. Thus, it is possible to restrict the occurrence of differences in the fineness of the filaments flowing through a spinning hole at the outermost row and the fineness of the filaments flowing through a spinning hole at the center row have been made after the drawing.

The drawing unit 3 in accordance with the present invention has the above-described structure. A description of how the filament groups 2 pushed out from the spinneret 1 are drawn will now be given.

From the suction inlets 10*a* provided at the top portions of the slits 10 of the drawing unit 3, the filament groups 2 pushed out from the spinneret 1 divide at and enter the plurality of slits 10. Then, they leave the outlets 10*b* of the corresponding slits 10, and move towards the collecting conveyor 6.

The air currents to be formed in the slits 10 are supplied to the first air chambers 18 from an air supply source, are led to the second air chambers 14 through the air connection paths 19, and ejected from the air ejection openings 14*a* formed by the edges of the corresponding top plates 12. The air currents cause the filament groups 2 to be drawn and sucked from the spinneret 1.

The filament groups 2 sucked into the suction inlets 10*a* are formed into continuous fibers 4 sufficiently subjected to the opening process at the outlets 10*b* by the drawing force produced by differences in the relative air flow speeds in the slits 10.

The air currents blown out from the slits 10 cause the continuous fibers 4 sufficiently subjected to the opening process blown out from the outlets 10*b* to join together above the collecting conveyor 6 including the suction box 8 and to move on the collecting conveyor 6, whereby the non-woven fabric web structure 5 is formed.

The air currents blown out from the outlets 10*b* become stagnant below the plate 13, causing the air currents blown out from the outlets 10*b* of the adjacent slits 10 to join together. This causes the filaments to scatter because the air currents mutually act upon each other. Therefore, compared to the case where a conventional drawing unit with only one slit is used, the extent to which an opening process is achieved is increased. Consequently, variations in the density of the continuous fibers 4 moving on the collecting conveyor 6 become less, making it possible to form a non-woven fabric web structure with uniform thickness.

Although a preferred embodiment of the present invention has been described, changes may be made without departing from the gist of the present invention. For example, in order to increase productivity of non-woven fabric web structures, the amount of spinning may be increased. Here, when the number of slits formed in the drawing unit is small, the number of filaments sucked into the slits is increased, so that, for example, the filaments get entangled in the slits. In such a case, the number of filaments per slit can be decreased by increasing the number of plates inserted and increasing the number of slits to be formed. This causes the productivity of non-woven fabric web structures to increase, so that problems resulting from the use of a larger number of filaments can be overcome.

Figure 4:
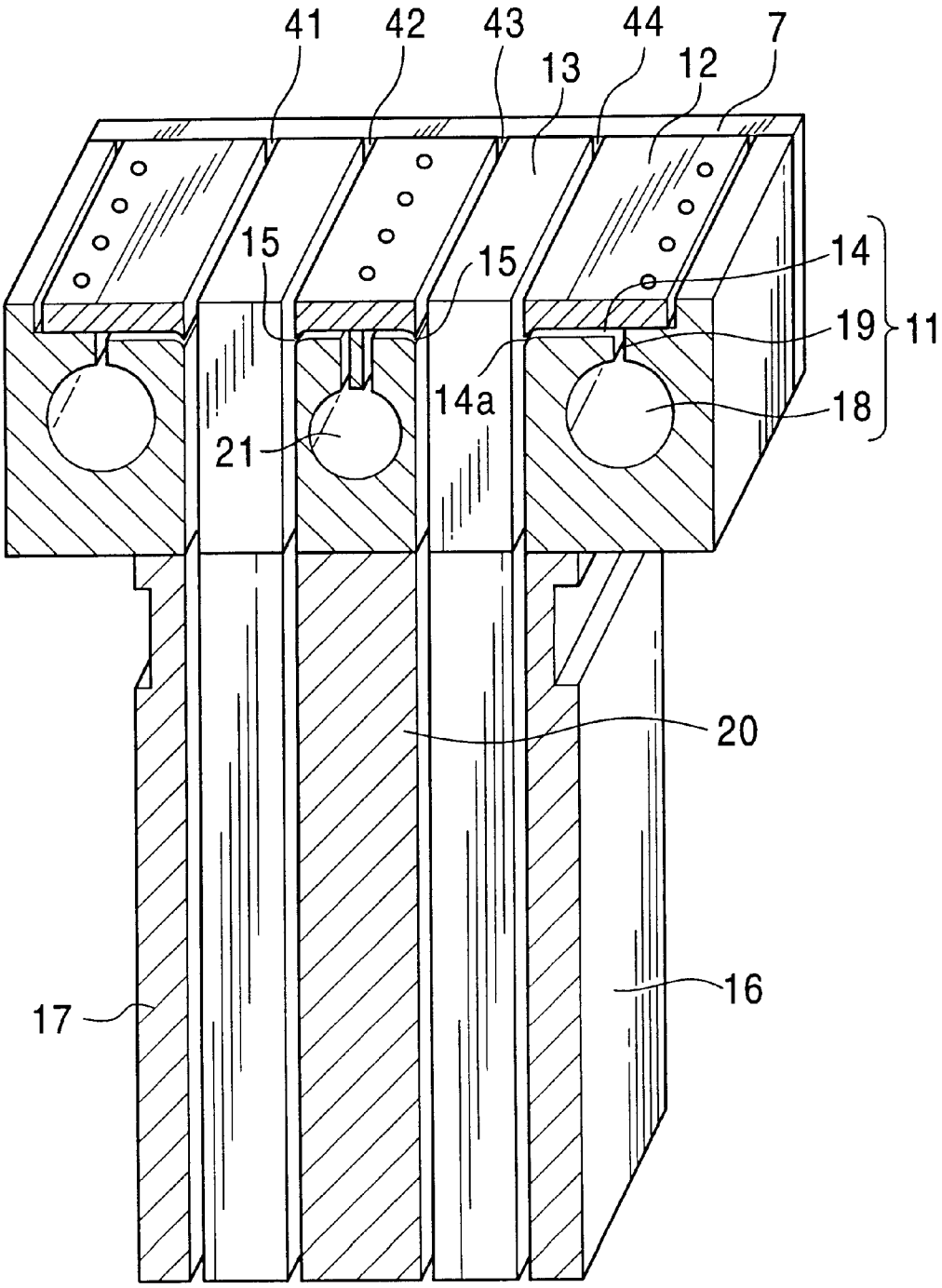
FIG. 4 is a perspective view of another embodiment of the drawing unit in accordance with the present invention.

For example, as shown in FIG. 4, a third member 20 which allows air to be ejected from both sides thereof is disposed between plates 13. The third member 20 comprises an air ejection section 21 including a third air chamber 15. In addition, a first member 16 and a second member 17 are disposed at outer sides of the plates 13, respectively. This makes it possible to form four slits 41, 42, 43, and 44. By virtue of such a structure, even if the number of filaments pushed out from a spinneret is increased, the filaments are divided at the slits 41, 42, 43, and 44, so that the number of filaments drawn in the slits is not increased. This makes it possible to, for example, reduce entanglement of the filaments in the slits, thereby allowing them to move towards a collecting conveyor.

Figure 5:
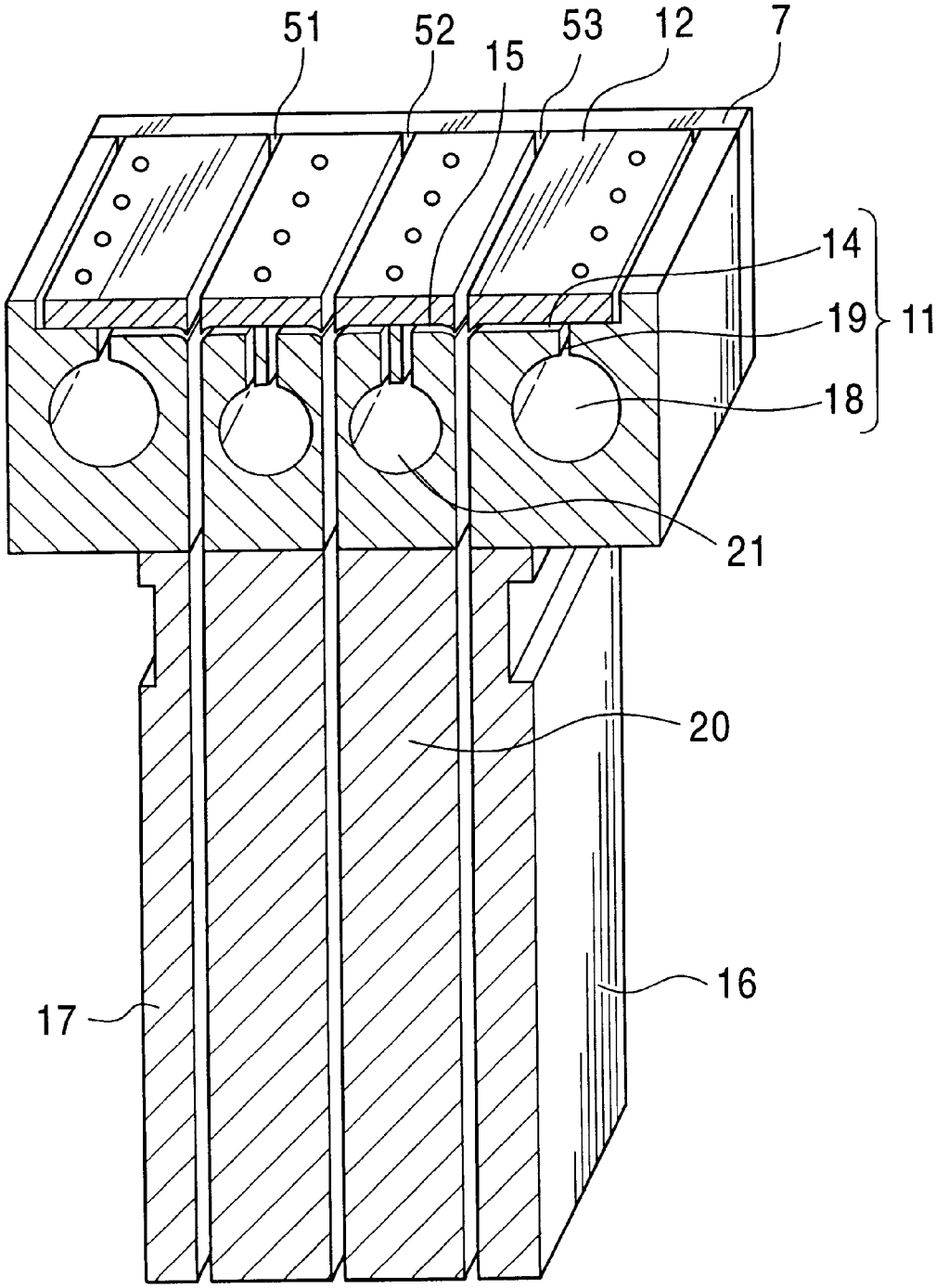
FIG. 5 is still another embodiment of the drawing unit in accordance with the present invention.

As shown in FIG. 5, more than one of the third member 20 described above which allows air to be ejected from both sides thereof and which comprises the air ejection section 21 including the third air chamber 15 is disposed between a first member 16 and a second member 17. This allows a plurality of slits 51, 52, and 53 to be formed. Accordingly, by using a structure which includes a proper combination of plates and members including air ejection sections in accordance with the number of filament groups pushed out from a spinneret, it is possible to draw the filaments and subject them to an opening process without increasing the number of filaments sucked into the slits formed by the combining of the plates and the members. Thus, a uniform non-woven fabric web structure can be formed.

Figure 6:
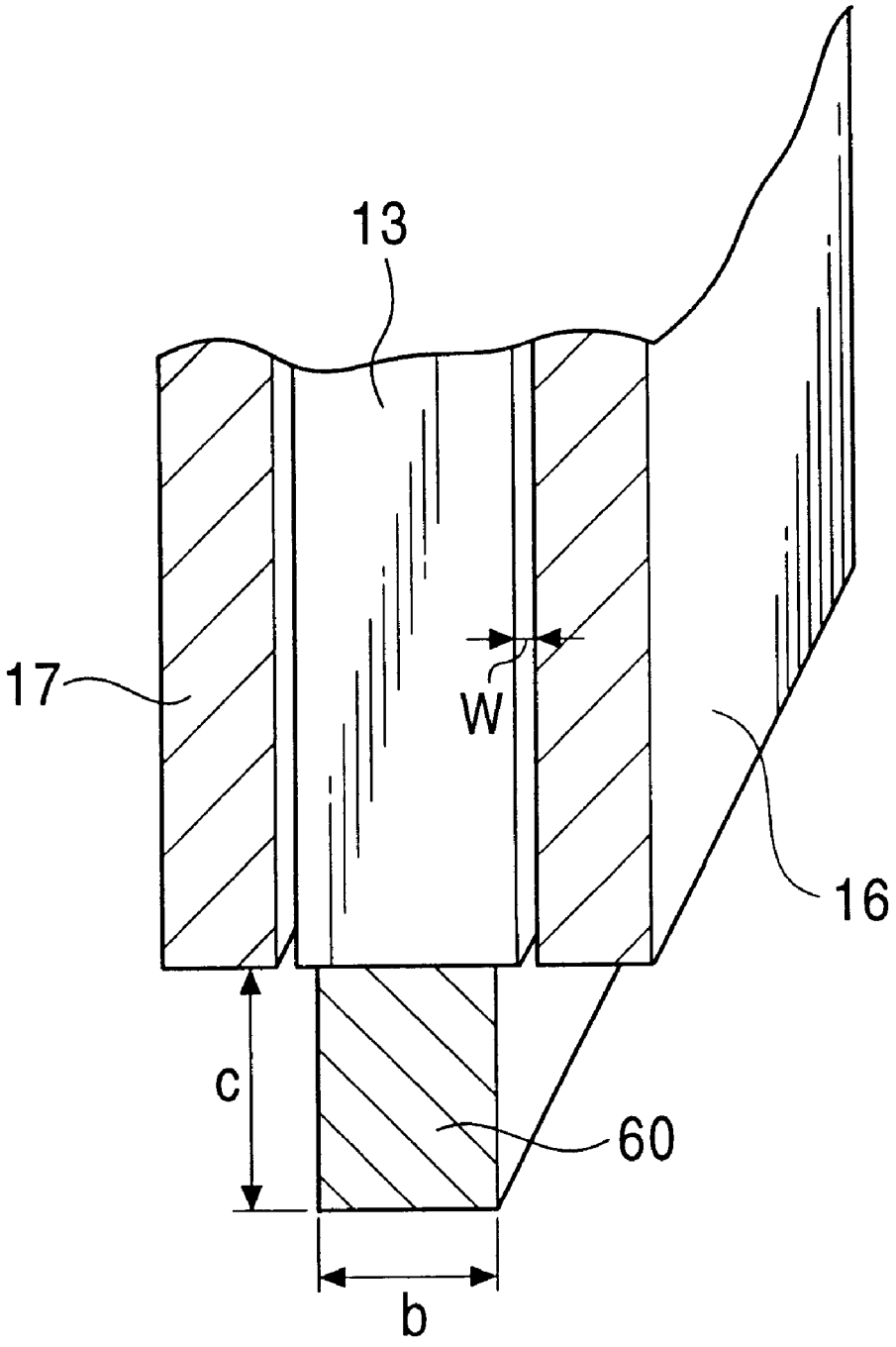
FIG. 6 is a perspective view illustrating an embodiment in which an air-current adjustor plate is mounted to a plate.

As shown in FIG. 6, an air-current adjustor plate 60 can be disposed below a plate 13. By changing a horizontal width b and height c of the air-current adjustor plate 60, the degree with which filament groups blown out from slits are joined together can be adjusted. The horizontal width b preferably is in a range of from 0.4 to 1 times the horizontal width of a plate 13. Although a preferred height cannot be unconditionally set because the height varies with the strength of air currents, it is in a range of from 100 mm to 500 mm.

Figure 7:
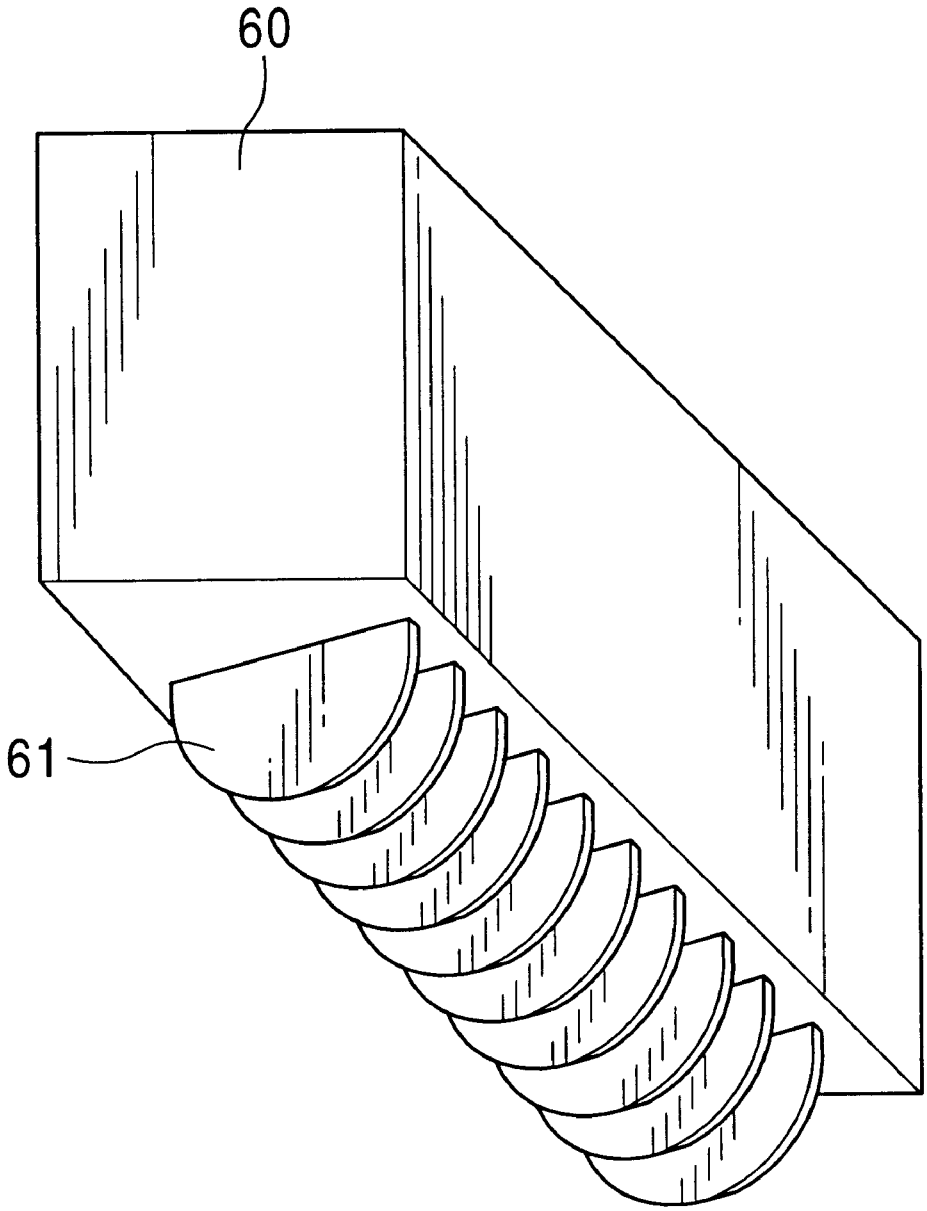
FIG. 7 is a perspective view of the air-current adjustor plate with flaps being mounted thereto.
Figure 8:
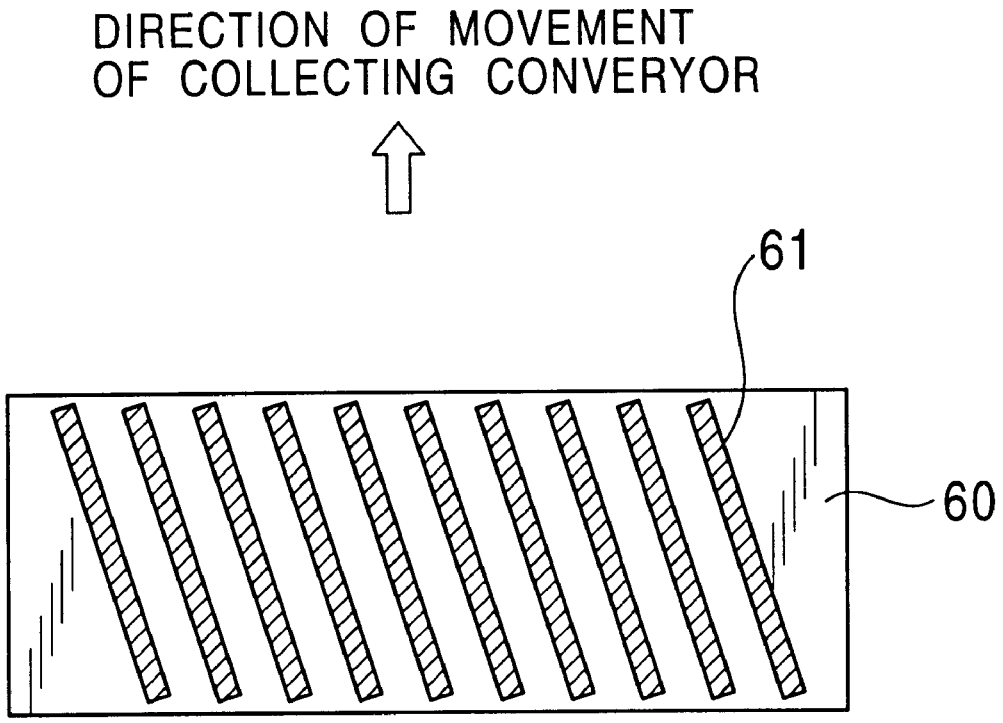
FIG. 8 illustrates the air-current adjustor plate with flaps being mounted thereto, as viewed from directly below them.

As shown in FIG. 7, flaps 61 may be formed below the air-current adjustor plate 60. The flaps 61 are provided to make the air flowing below the air-current adjustor plate 60 to flow at an angle from the direction of movement of a collecting conveyor (see FIG. 8). This causes the filaments to flow at an angle from the direction of movement of the collecting conveyor, so that the properties of the non-woven fabric web structures obtained can be varied. As long as the above-described object is achieved, any number of flaps or flaps of any shapes may be used. For example, the dimensions and shapes of the air-current adjustor plate 60 are adjusted to change the degree of the groups of filaments of the neighboring splits to jointly scatter upon the collecting conveyor.

Here, the present invention will be described in more detail with reference to the following examples.

Spinning was carried out at a rate of 0.55 g/min per spinning hole from a spinneret with holes each having a diameter of 0.3 mm. Polypropylene was used as a raw material for melt spinning. A filament width b was 1200 mm. The number of spinning holes was 2915. The number of rows of holes was 14. The drawing unit 3 was disposed so that the distance between it and the spinneret was 1200 mm. As shown in FIG. 2, in the drawing unit 3, the plate 13 was disposed between the first member 16 and the second member 17 including their corresponding air ejection sections 11, with the distance "a" between the two rows of slits 10 being 100 mm. The members 13, 16, and 17 were each secured to the side plate 7 with screws so that the width of each slit 10 was from 3 mm (at its entrance section) to 4.5 mm (at its exit section).

After obtaining the above-described structure, the pressures of the air ejection sections 11 of the first and second members 16 and 17 were kept at 2.5 kg/cm$^2$, and the spinning speeds at the outlets 10*b* of the slits 10 were 3300 m/min. Under these conditions, the polypropylene was drawn and was subjected to an opening process, whereby a non-woven fiber web structure was formed. It was found that the obtained non-woven fiber web structure had no density spots and had uniform thickness.

In another example, spinning was carried out under the following conditions. Polyethyleneterephtalate was used as a raw material for melt spinning. The pressure of each air-ejection section 11 was changed to 3.5 kg/cm$^2$. The spinning speed at each outlet 10*b* of its corresponding slit 10 was changed to 4800 m/min. Under these conditions, the polyethyleneterephtalate was drawn and was subjected to an opening process, whereby a non-woven fiber web structure was formed. As in the case where polypropylene was used, it was found that the non-woven fiber web structure had no density spots and had uniform thickness.

The present invention provides a drawing unit which is constructed as described above in which groups of filaments pushed out from a spinneret divide at passages or slits, are sucked into the slits, and are drawn. Therefore, the number of filaments that is sucked per path can be decreased, thereby reducing entanglement of the filaments in the paths. Consequently, the non-woven fiber web structure obtained has uniform thickness. In addition, by increasing the number of paths used to suck groups of filaments, it is possible to decrease the angles within which the filaments are contained at the suction openings of the drawing unit. Therefore, it is possible to restrict the occurrence of differences in the fineness of the filaments flowing through a spinning hole at the outermost row and the fineness of the filaments flowing through a spinning hole at the center row have been made after the drawing. Further, since the number of filaments used for spinning can be increased, the productivity of non-woven fabric web structures can be increased.

The number and widths of the slits and pitches between slits, and the type, thickness, and number of plates to be inserted can be set in various combinations, so that they can be arbitrarily set. Therefore, the groups of filaments drawn and blown out from the slits and subjected to an opening process can join together above a collecting conveyor, making it possible to adjust the degree with which the groups of filaments join together (that is, the degree of entanglement of the filament groups) above the collecting conveyor. In addition, ejected air currents come together between adjacent slits in order to reduce the extent to which the air currents spread above the collecting conveyor. Therefore, a non-woven fabric web structure with uniform thickness can be obtained.

What is claimed is:

1. A drawing unit for producing a non-woven fabric web, comprising:

a plurality of slits through which a plurality of filaments are drawn, each of the plurality of slits having an inlet end and an outlet end, the filaments being generated from a spinneret and then divided between the inlet ends of the plurality of slits so as to prevent tangling of the filaments;

means for generating suction at the inlet ends of the plurality of slits and air current to move the plurality of filaments through the plurality of slits and out of the outlet ends thereof; and a collecting conveyor for collecting the filaments blown out from the outlet ends of the plurality of slits so as to form the non-woven fabric web, wherein the plurality of slits extend in a widthwise direction of the collecting conveyor, and substantially perpendicular to a direction of movement of the collecting conveyor, the outlet ends of the plurality of slits being formed so as to adjustably combine the air currents from the outlet ends to uniformly scatter the plurality of filaments onto the collecting conveyor.

2. A drawing unit for producing a non-woven fabric web according to claim 1, wherein the slits are formed between a first member including a first air ejection section operatively connected with at least one of the slits and a second member including a second air ejection section operatively connected with at least one other of the slits, and at least one plate disposed between the first member and the second member so as to define the plurality of slits therebetween.

3. A drawing for producing non-woven fabric web according to claim 2, wherein at least two plates are formed between the first member and the second member, and a third member disposed between the at least two plates and the first member and the second member, the third member including air ejection sections operatively connected to at least two slits defined between the third member and the at least two plates.

4. A drawing unit for producing a non-woven fabric web according to claim 2, further comprising an air-current adjustor plate mounted below the plate.

5. A drawing unit for producing a non-woven fabric web, comprising:

a plurality of slits through which a plurality of filaments are drawn, each of the plurality of slits having an inlet end and an outlet end, the filaments being generated from a spinneret and then divided between the inlet ends of the plurality of slits so as to prevent tangling of the filaments;

means for generating suction at the inlet ends of the plurality of slits and air current to move the plurality of filaments through the plurality of slits and out of the outlet ends thereof; and a collecting conveyor for collecting the filaments blown out from the outlets ends of the plurality of slits so as to form the non-woven fabric web, wherein the plurality of slits extend in a widthwise direction of the collecting conveyor, and substantially perpendicular to a direction of movement of the collecting conveyor and at intervals allowing the plurality of filaments to join above the collecting conveyor, the outlet ends of the plurality of slits being formed so as to adjustably combine the air currents from the outlet ends to uniformly scatter the plurality of filaments onto the collecting conveyor.

6. A drawing unit for producing a non-woven fabric web according to claim 2, wherein each air ejection section including a cylindrical air chamber.

7. A drawing unit for producing a non-woven fabric web according to claim 6, wherein each air ejection section including a cylindrical air chamber and an air ejection tunnel linking between the chamber and the respective slit.

8. A drawing unit for producing a non-woven fabric web according to claim 7, wherein the size of an air ejection hole between the air ejection tunnel and the respective slit is adjusted to change speed of the air current therein.

9. A drawing unit for producing a non-woven fabric web according to claim 4, wherein the dimensions and shape of the air-current adjustor plate are adjusted to change the degree of the groups of filaments of the neighboring splits to jointly scatter upon the collecting conveyor.

10. A drawing unit for producing a non-woven fabric web according to claim 9, where the air-current adjustor plate is semi-circular.

11. A drawing unit for producing a non-woven fabric web according to claim 5, wherein the slits are formed between a first member including a first air ejection section air-communication with one of the slits and a second member including a second air ejection section air-communication with another one of the slits, and a plate being disposed between the slits.

12. A drawing for producing non-woven fabric web according to claim 11, wherein the plate is formed between the first member and the second member, and a third member disposed between the first member and the second member, the third member including air ejection sections air-communication with both slits.

13. A drawing unit for producing a non-woven fabric web according to claim 11, further comprising an air-current adjustor plate mounted below the plate.

14. A drawing unit for producing a non-woven fabric web according to claim 11, wherein each air ejection section including a cylindrical air chamber.

15. A drawing unit for producing a non-woven fabric web according to claim 14, wherein each air ejection section including a cylindrical air chamber and an air ejection tunnel linking between the chamber and the respective slit.

16. A drawing unit for producing a non-woven fabric web according to claim 15, wherein the size of an air ejection hole between the air ejection tunnel and the respective slit is adjusted to change speed of the air current therein.

17. A drawing unit for producing a non-woven fabric web according to claim 13, wherein the dimensions and shape of the air-current adjustor plate are adjusted to change the degree of the groups of filaments of the neighboring splits to jointly scatter upon the collecting conveyor.

18. A drawing unit for producing a non-woven fabric web according to claim 17, where the air-current adjustor plate is semi-circular.

* * * * *